United States Patent [19]

Kato

[11] 4,081,580

[45] * Mar. 28, 1978

[54] PAPER WRAPPER FOR WRAPPING REFRIGERATED MEAT

[76] Inventor: Eiji Kato, No. 2-11, Higashiteraokitadai, Tsurumi, Yokohama, Kanagawa, Japan

[ * ] Notice: The portion of the term of this patent subsequent to Sep. 2, 1992, has been disclaimed.

[21] Appl. No.: 607,709

[22] Filed: Aug. 25, 1975

Related U.S. Application Data

[63] Continuation-in-part of Ser. No. 415,443, Nov. 13, 1973, Pat. No. 3,902,650.

[51] Int. Cl.[2] ..... B65D 65/00; B32B 1/00

[52] U.S. Cl. ..... 428/134; 229/3.5 R; 229/87 F; 428/138; 428/174; 428/337

[58] Field of Search ..... 428/35, 43, 134, 138, 428/136, 174, 195, 155, 213, 218, 212, 246, 260, 337; 229/87 R, 3.1, 87 F, 3.5 R, 87 B, 87 P; 426/110, 119

[56] References Cited

U.S. PATENT DOCUMENTS

| | | | |
|---|---|---|---|
| 2,912,152 | 11/1959 | White | 229/14 |
| 3,003,884 | 10/1961 | Andrews | 426/129 X |
| 3,292,619 | 12/1966 | Egler | 428/138 X |
| 3,337,114 | 8/1967 | Lockwood | 229/87 R |
| 3,659,772 | 5/1972 | Dorsey et al. | 229/3.1 |
| 3,902,650 | 9/1975 | Kato | 428/337 X |

FOREIGN PATENT DOCUMENTS

| | | |
|---|---|---|
| 46-31476 | 9/1971 | Japan. |
| 469,145 | 7/1937 | United Kingdom. |

*Primary Examiner*—George F. Lesmes
*Assistant Examiner*—Alexander S. Thomas
*Attorney, Agent, or Firm*—Oblon, Fisher, Spivak, McClelland & Maier

[57] ABSTRACT

A paper wrapper is provided for wrapping refrigerated meats, which is characterized by a paper board for prevention of strength loss due to moisture pick-up during usage, and also for prevention of drying for good preservation and for easy separation of the meat from the box.

3 Claims, 2 Drawing Figures

PAPER WRAPPER FOR WRAPPING REFRIGERATED MEAT

Figure 1:
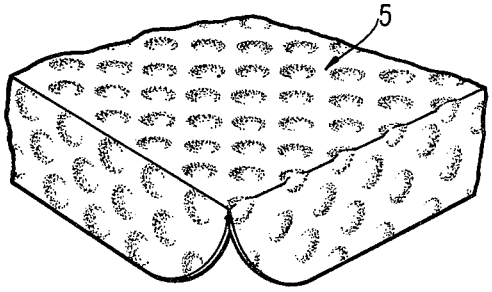

This application is a continuation-in-part of application Ser. No. 415,443 filed Nov. 13, 1973, now U.S. Pat. No. 3,902,650.

This invention relates to a paper wrapper, and more particularly to a paper wrapper which can be used for wrapping of refrigerated meats, and which is adapted to preferably and rapidly exhaust air and moisture discharged from said wrapped meats, particularly fish, animal or chicken meat, during the period in which refrigerated meat is contained therein for preservation and transportation.

Heretofore, in situations where meat has been wrapped in a paper box and then refrigerated, many problems have been noted, for example, the air and moisture normally discharged from the meat, when the contents of the paper box are compressed on wrapping or packing, are not sufficiently exhausted from the box. Consequently, the surface of the meat takes on a rough, irregular or cratered shape and ice tends to form and be entrapped in the meat. This seriously reduces the edibility and the commercial value of the meat. Moreover, moisture tends to be frozen between the inner surface of the box and the meat surface so that it becomes difficult to remove from the box. Also since the box is insufficiently water-proofed, the box tends to become wet and this reduces the strength of the box.

A box has recently been proposed which has fine raised patterns embossed randomly on the inner surface of the box. Since the embossed raised patterns, however, are mutually independent, air and moisture tends to accumulate within the recesses of the box since it cannot be sufficiently exhausted out of the box.

It is, therefore, one object of the present invention to provide a paper wrapper for wrapping refrigerated meat which will not be subject to reduced strength due to moisture retention.

It is another object of the present invention to provide a paper wrapper which can be used for wrapping refrigerated meats, which wrapper will function to dispel accumulated air and moisture as formed therein.

It is still another object of the present invention to provide a paper wrapper for wrapping refrigerated meat which will prevent the contents from such drying as to induce spoilage and which will facilitate separation of the contents from the wrapper after refrigeration.

In order to achieve the aforementioned and other objects, the wrapper of the present invention has better water resistance and water-proofing properties for meat wrapping purposes than normal paper board since it enables water to be discharged from the meat during refrigeration and subsequent melting. The thickness of the paper should be 20/100~80/100 mm in order to maintain the bursting strength within the range of 3.5 – 14 kg/cm$^2$ after embossing. The upper range is limited only by economic necessities and the lower range is determined by the predetermined necessary strength. The wrapper contains an embossed rugose pattern as described below.

The bursting strength of the paper wrapper is thus selected as indicated above so that when the wrapper and contents are under the stress of packing compressing and melting, differential cracking will appear in the waterproof coating. That is, when the waterproofed coating paper is under stress it will be so altered that a large differential in air permeability will occur as between the uneven or embossed portions and the normal areas. This results in the accumulated air and moisture being gradually displaced through the paper plies and out of the box. Such cracking at the embossed portions is very fine and may be either visible or invisible. Cracks may also be formed when the rugose portions are embossed since when the paper is tensioned some paper fibers will be broken. These will occur however, mainly in the waterproof coating when the paper wrapper contents are under the stress of packing, compressing and thawing.

As discussed above, the bursting strength of the paper wrapper must be maintained within 3.5 – 14 kg/cm$^2$ after embossing in terms of Mullen bursting strength as defined by JIS P-8131, preferably 3.5–12.5 kg/cm$^2$. If the bursting strength of the paper wrapper is greater than 14 kg/cm$^2$, it becomes impossible for the air and moisture to be discharged from the wrapper with the result that refrigeration will produce ice throughout the meat in the paper box. This results in greatly reducing the commercial value of the packed article.

The paper wrapper of the present invention has another feature in that the rugose patterns are embossed randomly, and preferably, recessed grooves for communication between the rugose patterns are formed in order to facilitate discharge of the air and water produced when the meat is wrapped in the paper wrapper. The depth of the rugose patterns, the volume per unit area of the recesses, and the angle of the rugose patterns with respect to the surface of the paper board are specifically defined in this invention.

The shape of the rugose patterns embossed on the paper of the wrapper of the present invention is not critical. Preferably, they are semi-elliptic or spherical recesses formed in such a manner that the length of one side, namely the diameter, is 1–8 mm., the intervals between the center points of the recesses are 0.5 – 8 mm., the density of the recesses is 2 –11/cm$^2$ and the depth of the recesses is 40 –130 % of the thickness of the paper, preferably, 70 – 110 %, and the recesses are so arranged as to be in a zig-zag form such that the recessed side will be on the inside of the wrapper.

If the depth of the recesses are less than 40 % of the thickness of the paper, the recesses will not function to permit sufficient discharge of the air and moisture from the paper wrapper. If they are over 130 %, the paper board of the wrapper will be so penetrated by the recesses as to lose the intended function of the recesses, because if there are fine penetrated holes throughout the paper board of the wrapper, which are caused by excessive recessing, the moisture initially discharged from the content in the paper wrapper is frozen therein, which will prevent discharge of subsequently formed air and moisture.

If the intervals between the recesses are over 8mm or the density of the recesses is less than 2/cm$^2$, the distribution of the waterproof coating of the rugose portions of the paper wrapper becomes excessively uneven so that the air and moisture cannot be sufficiently discharged from the paper wrapper. This results in the formation of foaming and stripe scarring on the surface of the contents. On the other hand, if the intervals between the recesses are less than 0.5 mm or the density of the recesses is over 11 /cm$^2$, the strength of the paper wrapper will be so weakened that compression of the contents in the paper wrapper on wrapping becomes difficult. In addition, if the length of one side of the recesses is less than 1 mm, it is difficult to obtain recesses having the aforesaid necessary depth, and, if the length of one side of the recesses is over 8 mm, the cracks formed per recess are far below what is required.

The paper wrapper of the present invention has still another feature namely that recessed grooves of 3/100–65/100 mm in depth are formed linearly or non-linearly for connecting the rugose patterns with each other as well as the portions corresponding to the upper four peripheral edges of the paper wrapper in order to evenly and efficiently discharge from the wrapper the air and moisture produced when meat is packed and compressed therein.

FIG. 1 is a fragmentary perspective view showing the rugose surface of the wrapper.

Figure 2:
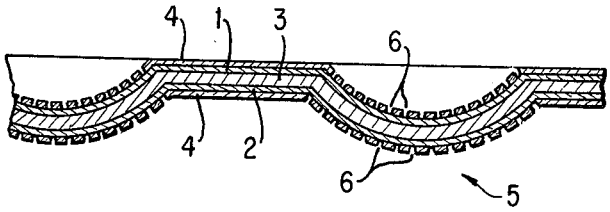

FIG. 2 is a cross-section showing in enlarged form a portion of a multi-ply paper board containing a rugose pattern. In FIG. 2, there is shown an upper paper ply 1, a lower paper ply 2, a central paper ply 3, a water-resistant coating 4, a recess 5 formed on the paper board by embossing, and cracks 6 formed in the water-resistant coating.

In view of the moisture produced upon refrigerating and thawing of the meat and the force applied to the paper wrapper upon removal of the meat from the paper wrapper for usage, the water resistance of the paper board of the wrapper after embossing is defined as 30–350g/m$^2$ and the air permeability thereof is defined as 50–200 sec./100cc.

The above cited water resistance values are obtained from a measurement which comprises pouring water at 20° C. into a ring, removing the water after 24 hours, removing the adhered water with a filter to measure the absorbed water, employing a moisture permeability cup described in JIS Z-0208. The above air permeability values are obtained from the measurement test described in JIS P-8117, and represent the average values of ten measurement tests.

If the water resistance is less than 30 g/m$^2$ (24 hours) at the recess surface, the moisture in the paper wrapper cannot be sufficiently discharged from the paper wrapper so that the paper wrapper contents are subject to deterioration, while if the water resistance is above 350 g/m$^2$ at the recess surface, an excessive amount of moisture is absorbed in the paper wrapper weakening it excessively. Thus, the water resistence is defined as indicated above in order to reduce the amount of water absorbed in the wrapper so as to give high effectiveness to the wrapper, to facilitate easy removal of the contents from the wrapper, and to economise expenses and man power. If the air permeability is less than 50 sec./100cc, the air in the paper wrapper is excessively exhausted so that proper preservation and stability of the contents cannot be maintained, whereas if the air permeability is above 200 sec./100cc, the air in the paper wrapper is not sufficiently discharged with the result that the quality of the contents is unacceptably lowered. The air permeability of the paper board of the wrapper is preferably within 50–200 sec./100cc. Thus, the air permeability is improved as indicated above, and when meat is being packed in the wrapper, it is possible to speed up the packing operation. The present invention further has as its chief object the improvement of productivity. In this connection the material paper board, which easily absorbs moisture, is strengthened of its water resistance according to the present invention. Accordingly, one of the merits of the present invention is that the paper wrapper or crater made according thereto possesses a smooth surface which will not easily become uneven or rugged.

If the paper wrapper is completely dehydrated, fine spaces tend to appear between the contents and the paper wrapper with the result that the air in the spaces shift about, thus proper preservation of the wrapper contents cannot be maintained. However, the paper wrapper of the present invention is slightly absorbent of the moisture so as to enable close contact between the contents and the paper wrapper whereby the air in the flat portion is exhausted thereby preventing the wrapper contents from drying, thus maintaining proper preservation. Further, the easy separation of the contents from the paper box is facilitated.

As indicated in the foregoing description, the paper wrapper of the present invention can maintain the strength of the wrapper against exposure to moisture during usage, can gradually discharge the air and moisture from the paper wrapper for proper preservation of the contents and also can prevent the content in the wrapper from drying, thereby maintaining proper content preservation and can facilitate easy removal of the contents from the paper wrapper under conditions of use as described above. There is thus provided an article of great commercial and industrial value.

The following Example is given by way of an illustration only.

EXAMPLE

A paper wrapper is made of a multi-ply paper board having a thickness of 50/100 mm, and coated on both sides for imparting water-proofing properties, and embossed in a zig-zag form with semi-elliptic spherical recesses having a density of 4/cm$^2$ of a side length of 2.5 mm × 4.5 mm. at intervals of 2 mm. with 90 % of the depth with respect to the thickness. The wrapper after embossing, has 650 sec/100 cc of air permeability, 36 g/m$^2$ of water resistance at the recess surface and 6.5 kg/cm$^2$ of bursting strength. Fish was packed in the wrapper and thereafter compressed for 3.5 hours at 40 kg/cm$^2$ of pressure during refrigeration.

The whole packing operation was completed with high rapidity. The contained fish was maintained in a proper state of preservation and was easily removed from the wrapper without any difficulty.

Having now fully described the invention, it will be apparent to one of ordinary skill in the art that many changes and modifications can be made thereto without departing from the spirit or scope of the invention as set forth herein.

What is claimed is:

1. A paper wrapper for wrapping refrigerated meat comprising single or multi-ply paper board having a thickness of 20/100–80/100 mm, and coated on both sides for imparting water-proofing properties, embossed with rugose patterns having a side length of 1–8 mm, with a depth of 40–130 % of the thickness of the paper at intervals of 0.5–8 mm, and at a density of 2–11/cm$^2$, having after embossing, a water resistance 30–350 g/m$^2$ at the rugose surface, an air permeability of 50–200 seconds/100 cc and a bursting strength of 3.5–14 kg/cm$^2$, and having fine cracking in the water-resistant coating at the rugose surface.

2. A paper wrapper according to claim 1, wherein said rugose patterns are in the form of semi-elliptic recesses said recesses being arranged in a zig-zag manner.

3. A paper wrapper according to claim 1, wherein said rugose patterns are in the form of spherical recesses, said recesses being arranged in a zig-zag manner.

* * * * *